US010026384B2

(12) United States Patent
Luminiello

(10) Patent No.: US 10,026,384 B2
(45) Date of Patent: Jul. 17, 2018

(54) REDUCED AIR LEAKAGE HARMONICA REED UNIT

(71) Applicant: David Luminiello, New Bedford, MA (US)

(72) Inventor: David Luminiello, New Bedford, MA (US)

( * ) Notice: Subject to any disclaimer, the term of this patent is extended or adjusted under 35 U.S.C. 154(b) by 0 days.

(21) Appl. No.: 15/489,491

(22) Filed: Apr. 17, 2017

(65) Prior Publication Data

US 2017/0301324 A1 Oct. 19, 2017

Related U.S. Application Data

(60) Provisional application No. 62/323,027, filed on Apr. 15, 2016.

(51) Int. Cl.
*G10D 9/02* (2006.01)
*G10D 7/12* (2006.01)

(52) U.S. Cl.
CPC ..... *G10D 9/023* (2013.01); *G10D 7/123* (2013.01)

(58) Field of Classification Search
None
See application file for complete search history.

(56) References Cited

U.S. PATENT DOCUMENTS 2,000,408 A * 5/1935 Borrah ..... G10D 7/123 84/313
6,359,204 B2 * 3/2002 Antaki ..... G10D 7/123 84/377

* cited by examiner

*Primary Examiner* — Kimberly Lockett

(57) ABSTRACT

A reduced air leakage harmonica reed unit contains a reed plate and a plurality of reed sections. The plurality of reed sections is attached to the reed plate with a fastening mechanism and positioned within a body of the harmonica. The reed plate consists of a plate body and a plurality of receiving slots that traverse through the plate body. The plurality of receiving slots are aligned with a U-shaped channel from each of the plurality of reed sections. Thus, air that is drawn or blown travels through the U-shaped channel from the plurality of reed sections and through the plurality of receiving slots. Since the U-shaped channel is precisely cut, air leakage is minimized and high quality sound is produced by triggering a vibrating membrane.

7 Claims, 9 Drawing Sheets

REDUCED AIR LEAKAGE HARMONICA REED UNIT

The current application claims a priority to the U.S. Provisional Patent application Ser. No. 62/323,027 filed on Apr. 15, 2016. The current application is filed on Apr. 17, 2017 while Apr. 15, 2017 and Apr. 16, 2017 were on a weekend.

FIELD OF THE INVENTION

The present invention relates generally to harmonica reeds and vibrating musical instrument components. In particular, the present invention relates to a harmonica reed unit that is manufactured into one piece to reduce air leakage.

BACKGROUND OF THE INVENTION

Harmonicas are free reed musical instruments most commonly used in blues, country, and folk music. These devices utilize reeds which vibrate due to air flow in order to produce different musical notes. Each reed is made from a thin strip of brass or other comparable material that is attached at an end to a reed plate. The pitch produced by each reed differs based on its size (length and thickness), its stiffness, as well as the direction of air flow, which is either drawn (sucked) or blown. Users can also "bend" notes, through adjustments of their embouchure when playing. Conventional harmonica reeds and reed pads are stamped out and mounted above a slot in a harmonica reed plate; however, this produces quite a bit of air leakage around the reed. Individuals will sometimes take a harmonica apart and bend inner components of reed plates to reduce air leakage, however, this is a timely process and is often done incorrectly.

It is therefore an objective of the present invention to introduce a reduced air leakage harmonica reed unit. The present invention comprises a harmonica reed unit. The reed unit is an elongated member and reed pad that are stamped out into a single piece of brass or other comparable material. The piece is then laser cut in order to form a vibrating membrane, which mimics the function of a harmonica reed. The vibrating member is mounted over a slightly oversized reed plate slot on a reed plate. The laser cut makes the device more airtight than standard harmonica reeds, which in turn produces more consistent sound quality. Overall, the present invention is simple, effective, and practical.

DETAIL DESCRIPTIONS OF THE INVENTION

All illustrations of the drawings are for the purpose of describing selected versions of the present invention and are not intended to limit the scope of the present invention.

The present invention introduces a reduced air leakage harmonica reed unit that can be used to obtain high sound quality from a harmonica. By utilizing the present invention, the time consuming and inefficient methods used for improving sound quality can be avoided.

To minimize air leakage and obtain higher sound quality, the present invention comprises a plurality of reed sections 5. Each of the plurality of reed sections 5 are designed to vibrate according to the air that is blown or drawn by a user, when playing the harmonica or other comparable wind instrument.

Figure 1:
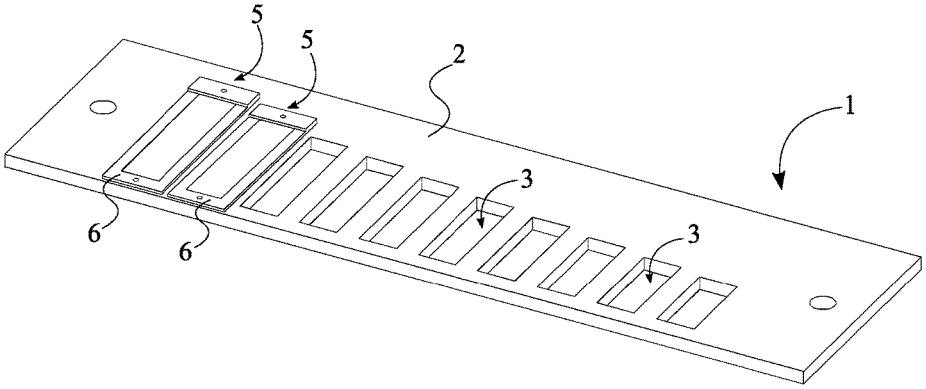
FIG. 1 is a perspective view of the present invention.
Figure 2:
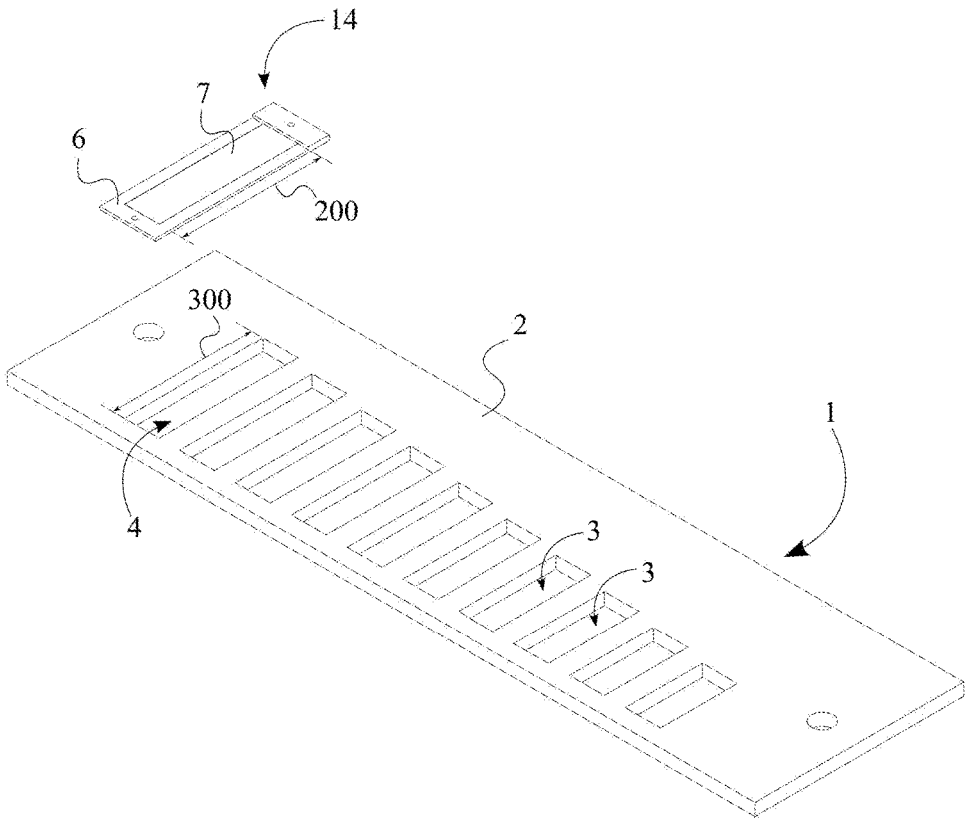
FIG. 2 is a perspective exploded view of a reed section from the plurality of reed sections and the reed plate.
Figure 3:
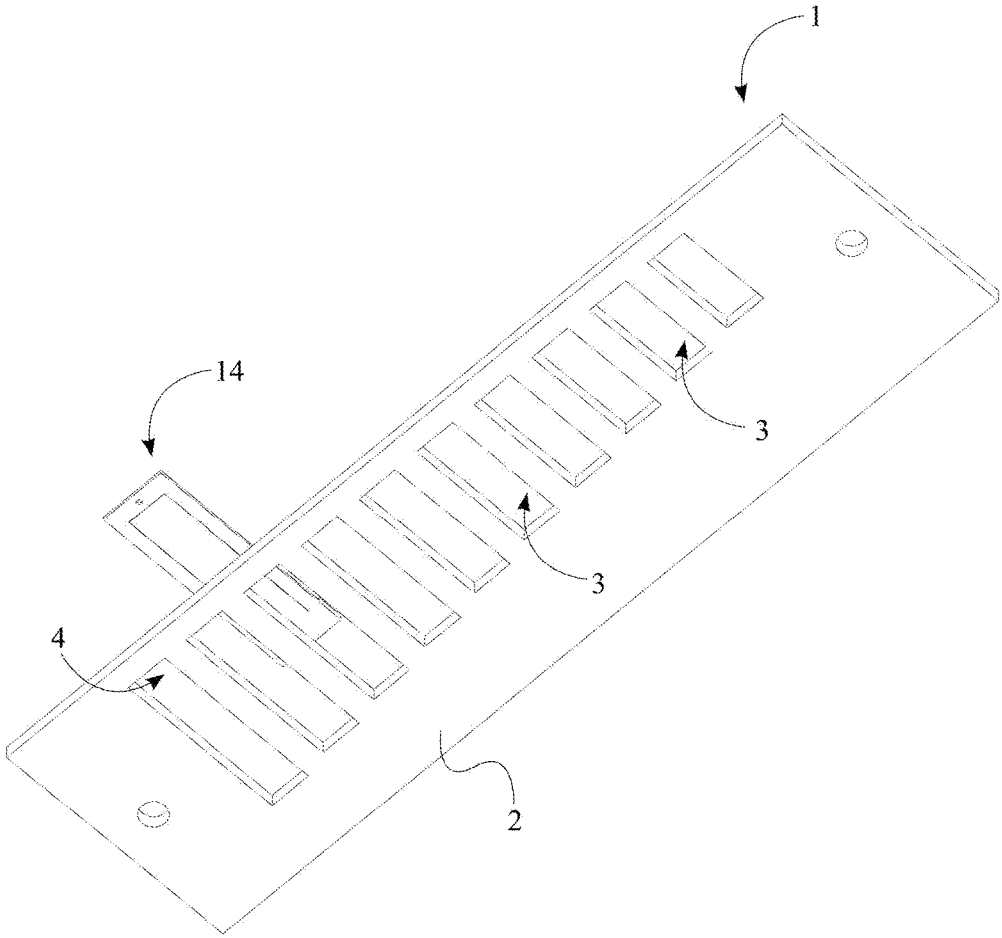
FIG. 3 is a bottom perspective exploded view of a reed section from the plurality of reed sections and the reed plate.
Figure 4:
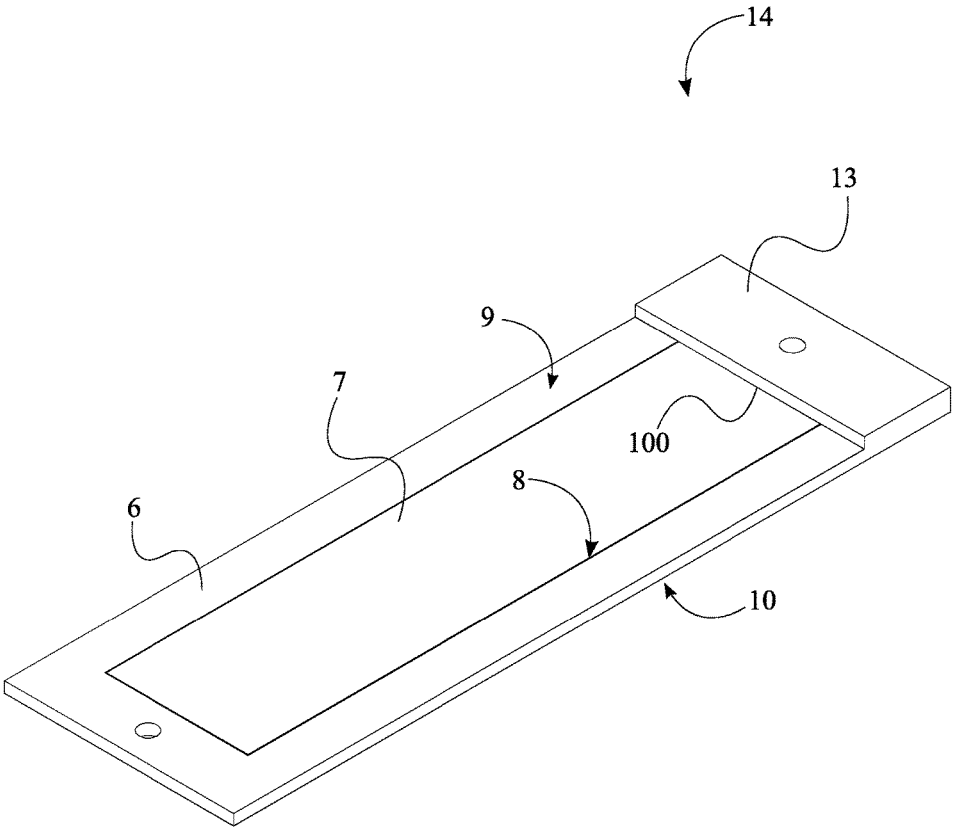
FIG. 4 is a perspective view of a reed section from the plurality of reed sections.

As illustrated in FIGS. 1-3, the plurality of reed sections 5 is used with a reed plate 1 that is used to hold the plurality of reed sections 5. When appropriately positioned, the reed plate 1 and the plurality of reed sections 5 are internally positioned within a body of the harmonica. The reed plate 1 and the plurality of reed sections 5 work in conjunction to produce the preferred sound quality from the harmonica by reducing air leakage.

The reed plate 1 comprises a plate body 2 and a plurality of receiving slots 3. The plurality of receiving slots 3 serve as airways for the air to pass through the plate body 2. The size and shape of the plurality of receiving slots 3 is equivalent to the receiving slots of a traditional reed plate. In particular, the plurality of receiving slots 3 is designed to produce different pitches on a musical scale through variations in the size of each of the plurality of receiving slots 3. Each of the plurality of receiving slots 3 is rectangular in shape, and the plurality of receiving slots 3 is equidistantly distributed along the plate body 2 and traverse through the plate body 2.

As mentioned earlier, the plurality of receiving slots 3 and the plurality of reed sections 5 are arranged to produce the desired musical notes. Each of the plurality of reed sections 5 is sized and shaped to be positioned with a corresponding slot 4 from the plurality of receiving slots 3. Therefore, each of the plurality of reed sections 5 also have a rectangular surface area. As illustrated in FIGS. 4-7, to aid in the process of producing high quality musical notes, each of the plurality of reed sections 5 comprises a first end 11, a second end 12, a structural body 6, a vibrating membrane 7, a U-shaped channel 8, a top surface 9, and a bottom surface 10. The structural body 6 of a corresponding reed section 14 from the plurality of reed sections 5 is sized and shaped per the size and shape of a corresponding slot 4 from the plurality of receiving slots 3. The structural body 6, which extends from the first end 11 to the second end 12, is preferably made of brass or other comparable lightweight material. The top surface 9 and the bottom surface 10 are positioned opposite to each other and across the structural body 6. Therefore, a distance between the top surface 9 and the bottom surface 10 determines a thickness of the structural body 6. The vibrating membrane 7 of each of the plurality of reed sections 5 is hingedly connected to the structural body 6 at a fixed end 100 which is positioned adjacent to the first end 11. The hinged connection allows the vibrating membrane 7 to vibrate by the air that is drawn or blown through the U-shaped channel 8 of each of the plurality of reed sections 5. The U-shaped channel 8 is used to initiate the movement of the vibrating membrane 7 by letting air pass through the structural body 6. To do so, the U-shaped channel 8 traverses through the structural body 6 from the top surface 9 to the bottom surface 10. The vibrating membrane 7 is offset from the structural body 6 by the U-shaped channel 8 as shown in FIG. 8A and FIG. 8B. Thus, when air passes through the U-shaped channel 8, the vibrating membrane 7 vibrates accordingly within the structural body 6. The U-shaped channel 8 is preferably cut with a laser so that air leakage through the U-shaped channel 8 is minimized. The reduced air leakage helps produce a more consistent output of sound.

As discussed before, the plurality of reed sections 5 is attached to the reed plate 1. In doing so, the U-shaped channel 8 of the corresponding reed section 14 is aligned with the corresponding slot 4. Thus, the air that passes through the corresponding slot 4 also travels through the U-shaped channel 8 so that the vibrating membrane 7 of the corresponding reed section 14 vibrates accordingly. For the corresponding reed section 14 to be appropriately aligned with the corresponding slot 4, a length 200 of the U-shaped channel 8 is equal to a length 300 of the corresponding slot 4 as illustrated in FIG. 2. Moreover, each of the plurality of reed sections 5 is manufactured from a lightweight material such as brass so that the vibrating membrane 7 is sensitive to air drawn or blown through the U-shaped channel 8.

Figure 5:
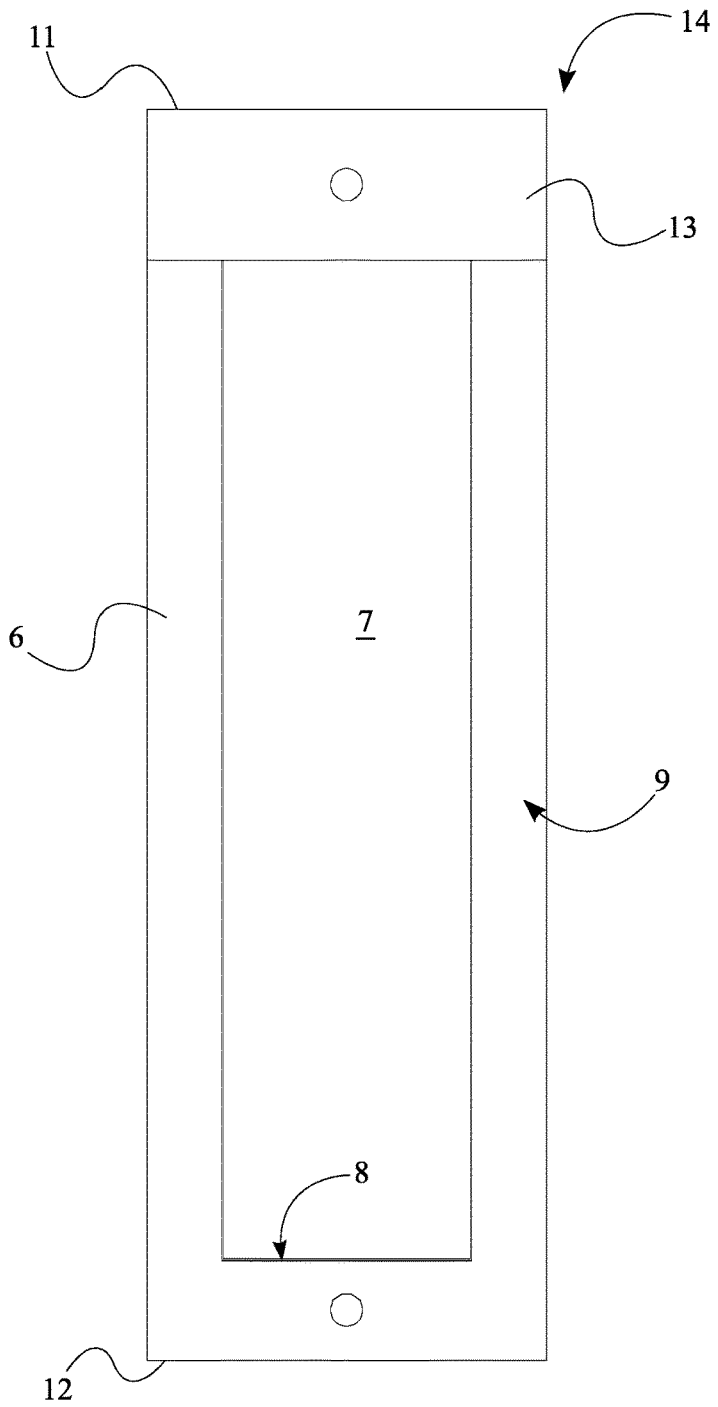
FIG. 5 is a top view of a reed section from the plurality of reed sections.
Figure 6:
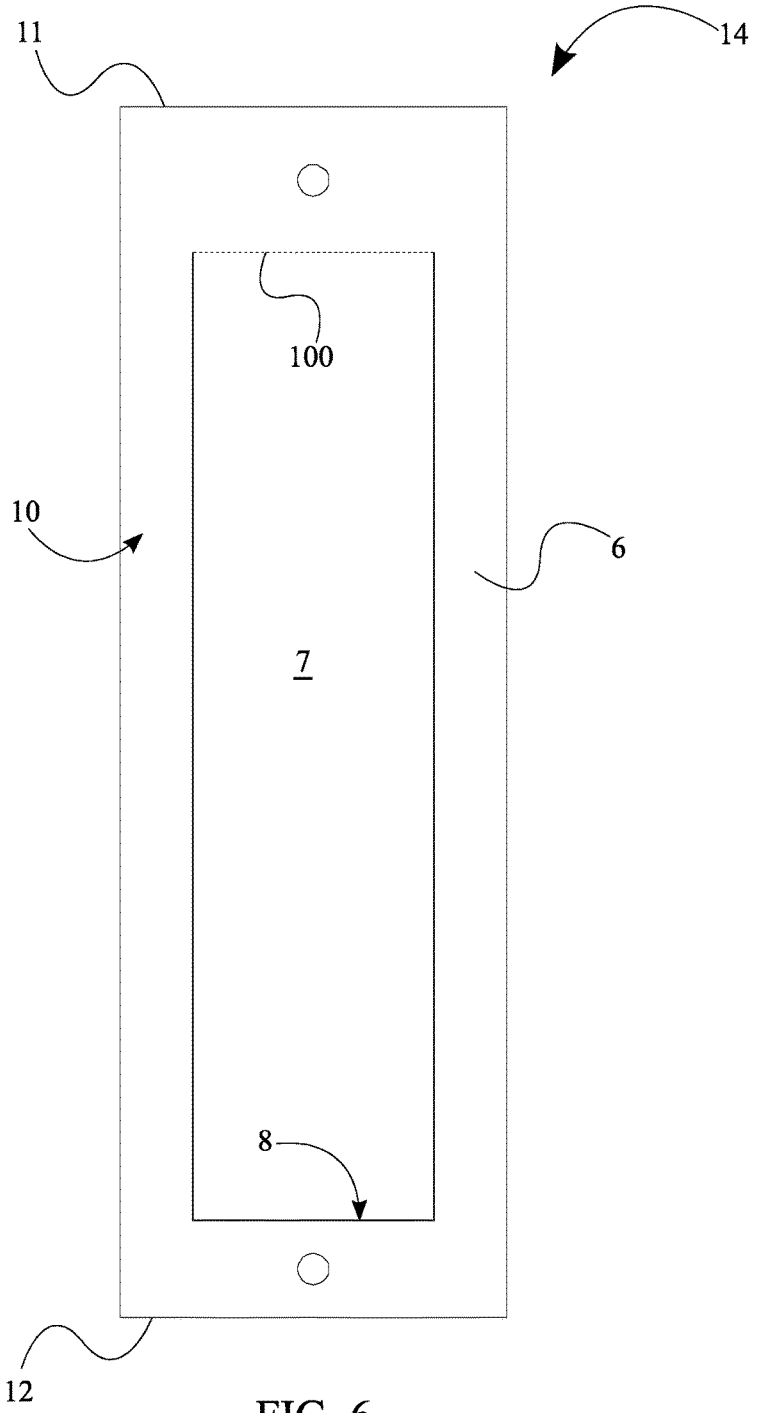
FIG. 6 is a bottom view of a reed section from the plurality of reed sections.

As seen in FIG. 5 and FIG. 6, each of the plurality of reed sections 5 further comprises the first end 11 and the second end 12. Since the structural body 6 extends from the first end 11 to the second end 12 a length of the structural body 6 is determined by the distance between the first end 11 and the second end 12. Each of the plurality of reed sections 5 is mounted to the reed plate 1 at the first end 11 and the second end 12 via a fastening mechanism 15 that can vary in different embodiments of the present invention.

Figure 7:
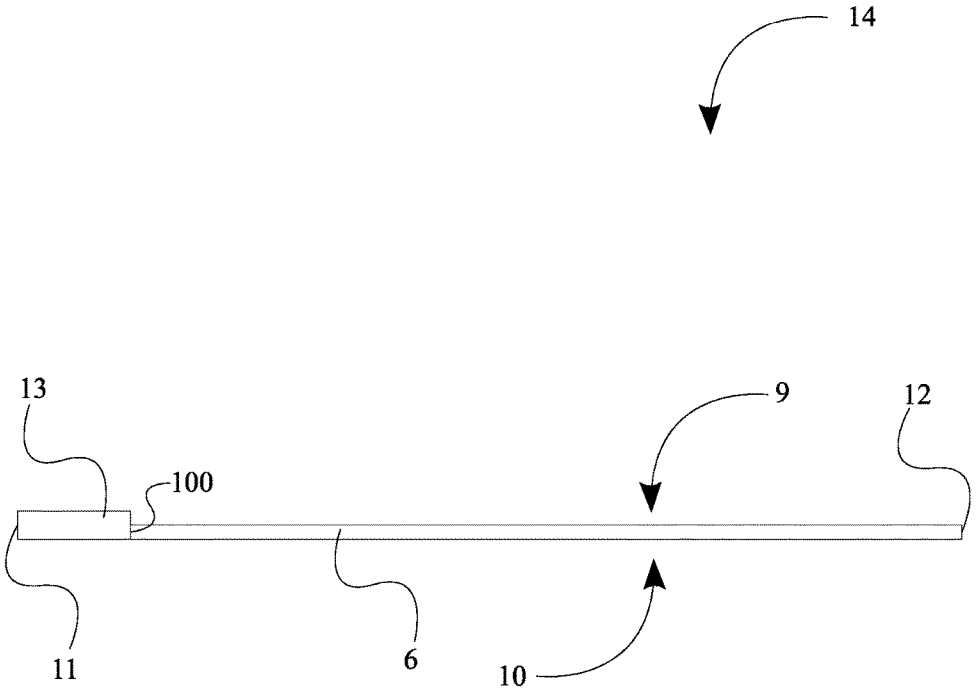
FIG. 7 is a side view of a reed section from the plurality of reed sections.
Figure 8A:
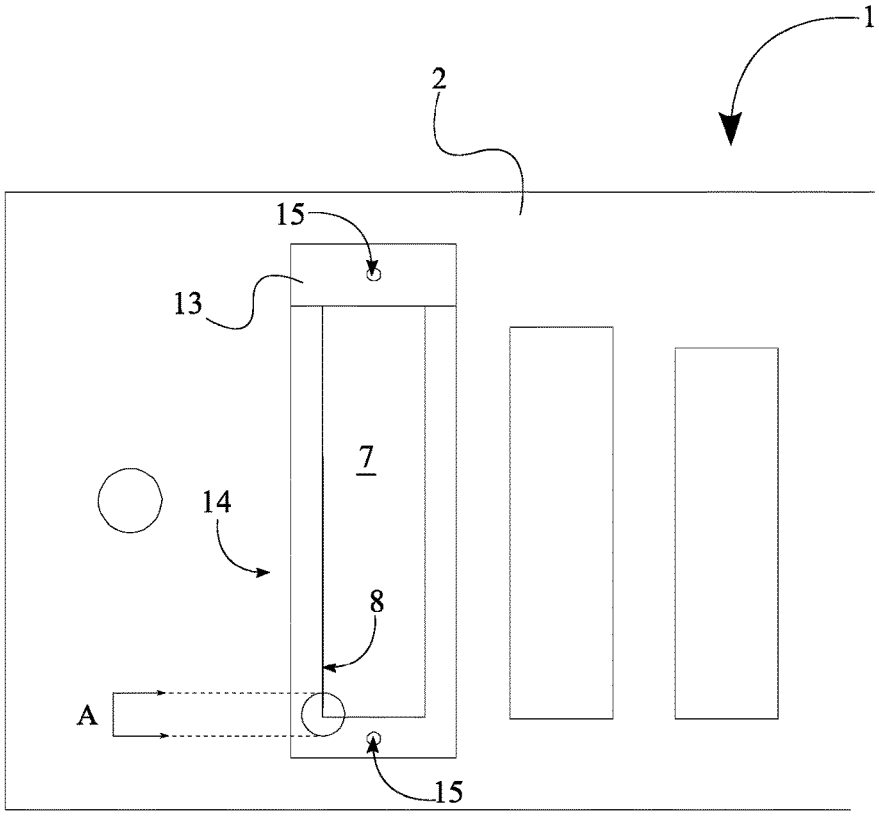
FIG. 8A is a top view of the reed section being attached to the reed plate.
Figure 8B:
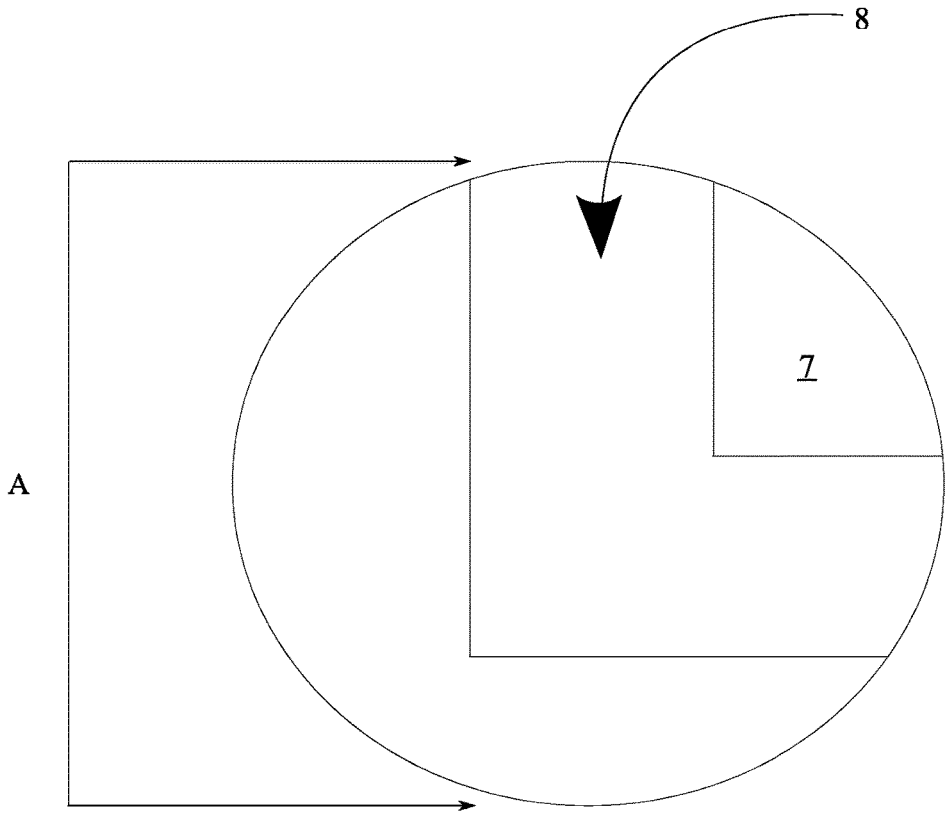
FIG. 8B is a magnified view illustrating the U-shaped channel illustrated in FIG. 8A.

As illustrated in FIG. 7, each of the plurality of reed sections 5 further comprises a pad 13 which provides additional stability to the structural body 6. The pad 13 is connected to the top surface 9 adjacent to the first end 11 of each of the plurality of reed sections 5. More specifically, the pad 13 is positioned in between the fixed end 100 and the first end 11 providing additional thickness to the structural body 6 at the first end 11.

As illustrated in FIG. 8A, the present invention further comprises a fastening mechanism 15 which is used to attach the plurality of reed sections 5 to the reed plate 1. The fastening mechanism 15 can vary in different embodiments of the present invention. Preferably, rivets, fasteners or other comparable methods are used to attach the plurality of reed sections 5 to the reed plate 1. As an example, if rivets are being used, the rivets are positioned so that each of the plurality of reed sections 5 and the reed plate 1 are held together at the first end 11 and the second end 12 of each of the plurality of reed sections 5.

When the present invention is being used, the following process flow is generally followed. The corresponding reed section 14 is positioned above the corresponding slot 4. The corresponding slot 4 is selected from the plurality of receiving slots 3 by matching the length of the corresponding slot 4 with the length of the U-shaped channel 8 of the corresponding reed section 14. In other words, the U-shaped channel 8 of the corresponding reed section 14 is aligned with the corresponding slot 4. By aligning the U-shaped channel 8 and the corresponding slot 4 air drawn or blown through the U-shaped channel 8 and the corresponding slot 4 vibrates the vibrating membrane 7 accordingly. When appropriately aligned, the corresponding reed section 14 is attached to the reed plate 1 with the fastening mechanism 15. The rivets or screws of the fastening mechanism 15 ensure that the corresponding reed section 14 is pressed against the reed plate 1 over the corresponding slot 4. The same procedure of aligning and attaching is repeated for the remainder of the plurality of reed sections 5.

Although the invention has been explained in relation to its preferred embodiment, it is to be understood that many other possible modifications and variations can be made without departing from the spirit and scope of the invention as hereinafter claimed.

What is claimed is:

1. A reduced air leakage harmonica reed unit comprises:
- a plurality of reed sections;
- each of the plurality of reed sections comprises a structural body, a vibrating membrane, a U-shaped channel, a top surface, and a bottom surface;
- the vibrating membrane being hingedly connected to the structural body at a fixed end;
- the vibrating membrane being offset from the structural body by the U-shaped channel;
- the U-shaped channel traversing through the structural body from the top surface to the bottom surface;
- the U-shaped channel of a corresponding reed section of the plurality of reed sections being aligned with a corresponding slot of the plurality of receiving slots;
- each of the plurality of reed sections further comprises a first end and a second end;
- the structural body extending from the first end to the second end;
- each of the plurality of reed sections being mounted to the reed plate at the first end and the second end;
- each of the plurality of reed sections further comprise a pad;
- the pad being connected to the top surface adjacent to the first end for each of the plurality of reed sections; and
- the pad being positioned in between a fixed end of the vibrating membrane and the first end.

2. The reduced air leakage harmonica reed unit as claimed in claim 1 comprises:
- a reed plate;
- the reed plate comprises a plate body and a plurality of receiving slots;
- the plurality of receiving slots being equidistantly distributed along the plate body;
- the plurality of receiving slots traversing through the plate body; and
- the plurality of reed sections being attached to the reed plate.

3. The reduced air leakage harmonica reed unit as claimed in claim 1 comprises:
- a fastening mechanism; and
- each of the plurality of reed sections being attached to the reed plate with the fastening mechanism.

4. The reduced air leakage harmonica reed unit as claimed in claim 1, wherein a length of the U-shaped channel is equal to a length of the corresponding slot.

5. The reduced air leakage harmonica reed unit as claimed in claim 1, wherein each of the plurality of reed sections is manufactured from brass.

6. The reduced air leakage harmonica reed unit as claimed in claim 1, wherein the structural body is rectangular.

7. The reduced air leakage harmonica reed unit as claimed in claim 1, wherein each of the plurality of receiving slots is rectangular.

* * * * *